US012103735B2

(12) United States Patent
Lavrykova-Marrain et al.

(10) Patent No.: US 12,103,735 B2
(45) Date of Patent: Oct. 1, 2024

(54) PACKAGING FOR PLATES

(71) Applicants: Meso Scale Technologies, LLC., Rockville, MD (US); Merrill's Packaging, Inc., Burlingame, CA (US)

(72) Inventors: Nataliya Lavrykova-Marrain, Gaithersburg, MD (US); Jonathan Vu Tran, Burlingame, CA (US)

(73) Assignee: Meso Scale Technologies, LLC., Rockville, MD (US)

( * ) Notice: Subject to any disclaimer, the term of this patent is extended or adjusted under 35 U.S.C. 154(b) by 33 days.

(21) Appl. No.: 17/534,773

(22) Filed: Nov. 24, 2021

(65) Prior Publication Data

US 2022/0161968 A1 May 26, 2022

Related U.S. Application Data

(60) Provisional application No. 63/118,155, filed on Nov. 25, 2020.

(51) Int. Cl.

| | |
|---|---|
| ***B65D 25/10*** | (2006.01) |
| ***B65D 43/16*** | (2006.01) |
| ***B65D 85/44*** | (2006.01) |

(52) U.S. Cl.

CPC ..... *B65D 25/107* (2013.01); *B65D 43/162* (2013.01); *B65D 43/163* (2013.01); *B65D 85/44* (2013.01); *B65D 2543/00296* (2013.01)

(58) Field of Classification Search

CPC .. B65D 5/5085; B65D 25/103; B65D 25/107; B65D 2543/00296; B65D 85/44; B65D 43/163; B65D 43/162

USPC ..... 206/564, 485, 707, 454, 587

See application file for complete search history.

(56) References Cited

U.S. PATENT DOCUMENTS

| | | | | |
|---|---|---|---|---|
| 3,107,204 A * | 10/1963 | Brown | B65D 75/323 206/1.5 |
| 4,040,518 A * | 8/1977 | Carter | B65D 25/107 D6/633 |
| 4,201,298 A * | 5/1980 | Larson | B65D 25/107 206/387.14 |

(Continued)

FOREIGN PATENT DOCUMENTS

| | | |
|---|---|---|
| WO | 1998014391 A1 | 4/1998 |
| WO | 2020219901 A1 | 10/2020 |

OTHER PUBLICATIONS

International Search Report dated Feb. 11, 2022, received in a corresponding foreign application, 13 pages.

*Primary Examiner* — Chun Hoi Cheung

(74) *Attorney, Agent, or Firm* — Scully, Scott, Murphy & Presser, P.C.

(57) ABSTRACT

The disclosure is directed to a package for containing a plurality of substantially rectangular assay plates, each plate having a peripheral flange. In one embodiment, the package comprises a cavity having extending therein one or more sloped buttress elements spaced across at least a portion of a top corner, and one or more adjacent protrusions extending from the bottom and at least partially up one or both sidewalls, each set of protrusions forming grooves therebetween into which fit the flanges of respective assay plates. The package can comprise a transparent polymer through which product information located on the assay plates can be read or scanned.

18 Claims, 17 Drawing Sheets

(56) References Cited

U.S. PATENT DOCUMENTS

| | | | | | |
|---|---|---|---|---|---|
| 4,231,473 | A * | 11/1980 | Aprahamian | G11B 23/0236 | 211/40 |
| 4,518,084 | A * | 5/1985 | Berkman | G11B 23/0236 | 206/387.1 |
| 4,744,463 | A * | 5/1988 | Merzon | G11B 23/0236 | 312/9.54 |
| 4,782,949 | A * | 11/1988 | Berkman | G11B 23/0236 | 312/9.54 |
| 4,986,414 | A * | 1/1991 | Ashley | B65D 55/02 | 206/5.1 |
| 5,297,675 | A * | 3/1994 | Martucci | G11B 23/0236 | 312/9.54 |
| 5,299,688 | A * | 4/1994 | McKay | A45C 11/18 | 206/425 |
| 5,441,150 | A * | 8/1995 | Ma | B65D 25/107 | 220/675 |
| 5,623,813 | A * | 4/1997 | Ma | H05K 13/0084 | 53/475 |
| 5,857,573 | A * | 1/1999 | Pakeriasamy | B65D 25/107 | 206/723 |
| 6,010,007 | A * | 1/2000 | Moren | B65D 25/107 | 206/592 |
| 6,303,389 | B1 | 10/2001 | Levin et al. | | |
| 8,454,909 | B2 * | 6/2013 | Martinell Gispert-Sauch | B01L 9/06 | 422/561 |
| 10,896,697 | B2 * | 1/2021 | Sumiya | B65D 85/671 | |
| 2016/0178625 | A1 | 6/2016 | Scott et al. | | |

* cited by examiner

PACKAGING FOR PLATES

RELATED APPLICATION

This application claims priority under 35 U.S.C. § 119 to provisional application U.S. Ser. No. 63/118,155 filed Nov. 25, 2020, the entire contents of which are incorporated herein by reference.

FIELD

The disclosure is directed to packaging for assay plates, e.g. as used in diagnostics and similar biological and testing instances. The packaging provides for improved and easier handling which is more economically efficient, environmentally friendly, and provides for more secure storage and facile shipping of such plates.

BACKGROUND

A typical assay plate is of generally rectangular shape having a width, length, and height, and having a top side usually comprising a plurality of wells into which can be disposed various reagents or biological materials, and a bottom surface that can be metalized to enable certain electronic aspects of the assay or otherwise configured to facilitate diagnostics. In some instances, there is an outwardly directed flange that extends around the entire periphery of the plate often extending from at or near the bottom edge. Commonly associated with the flange is a recessed ledge portion configured to permit the top of one plate to nest within the bottom of another, thereby allowing the stacking of multiple such plates. Packaging of such assay plates is a labor intensive, mostly if not entirely manual process which currently entails assembling the plates into stacks, each stack having a certain number of plates, then placing the stacks into pouches which are then sealed and labeled, including with machine readable identifiers having various product and/or other information which has to be scanned into one or more databases for tracking, customer, and other uses. The pouches are placed within a shipping box, which box is then sealed and labeled again with machine readable identifiers which were scanned into databases for tracking, updating and the like, whereafter the box is sent to shipping wherefrom it is sent to a customer. Additionally, stickers to instruct the customer where to cut the box so as to not damage the contents and how to reseal the pouch are usually provided, e.g. on the box or by ancillary documents. Protective packaging elements, which add to cost and handling, such as foam inserts, bubble wrap, portioning of the box are often utilized as well, all of which are eventually discarded leading to increase waste. Thus there is a need for an assay plate package which is easier to use and which reduces cost and waste.

SUMMARY

The disclosure is directed to an assay plate package that comports with the before stated needs. In one embodiment, the assay plate comprises an upper shell connected by a hinge member to a lower shell and cooperatively defining with the lower shell a cavity when the upper and lower shells are in a closed position, the cavity configured to contain a plurality of substantially rectangular assay plates, each plate comprising a top side and a bottom side, an edge flange extending around the periphery of the plate, a plate outer sidewall having a width and extending orthogonally from the edge flange and around the periphery of the plate, and a chamfered corner portion. The upper shell comprises a substantially rectangular planar top panel having a pair of opposed substantially parallel first and second upper shell end walls, a pair of opposed substantially parallel first and second upper shell sidewalls, and at least one buttress element located catercorner to a portion of the first upper shell sidewall and the top panel and extending into the cavity, the buttress element having a sloped surface complementary to the chamfered corner portion of the assay plate and configured to contact the chamfered corner portion of a respective assay plate when the upper and lower shells are in a closed position. The lower shell comprises a substantially rectangular planar bottom panel having a pair of opposed substantially parallel first and second lower shell end walls, a pair of opposed substantially parallel first and second lower shell sidewalls, wherein at least the first lower shell sidewall or the second lower shell sidewall comprises at least one pair of adjacent protrusions extending into the cavity from the first or second lower shell sidewall upwardly from the bottom panel, the pair of adjacent protrusions forming a groove therebetween, the groove configured to receive a portion of a flange portion of a respective assay plate.

DETAILED DESCRIPTION

Figure 1:
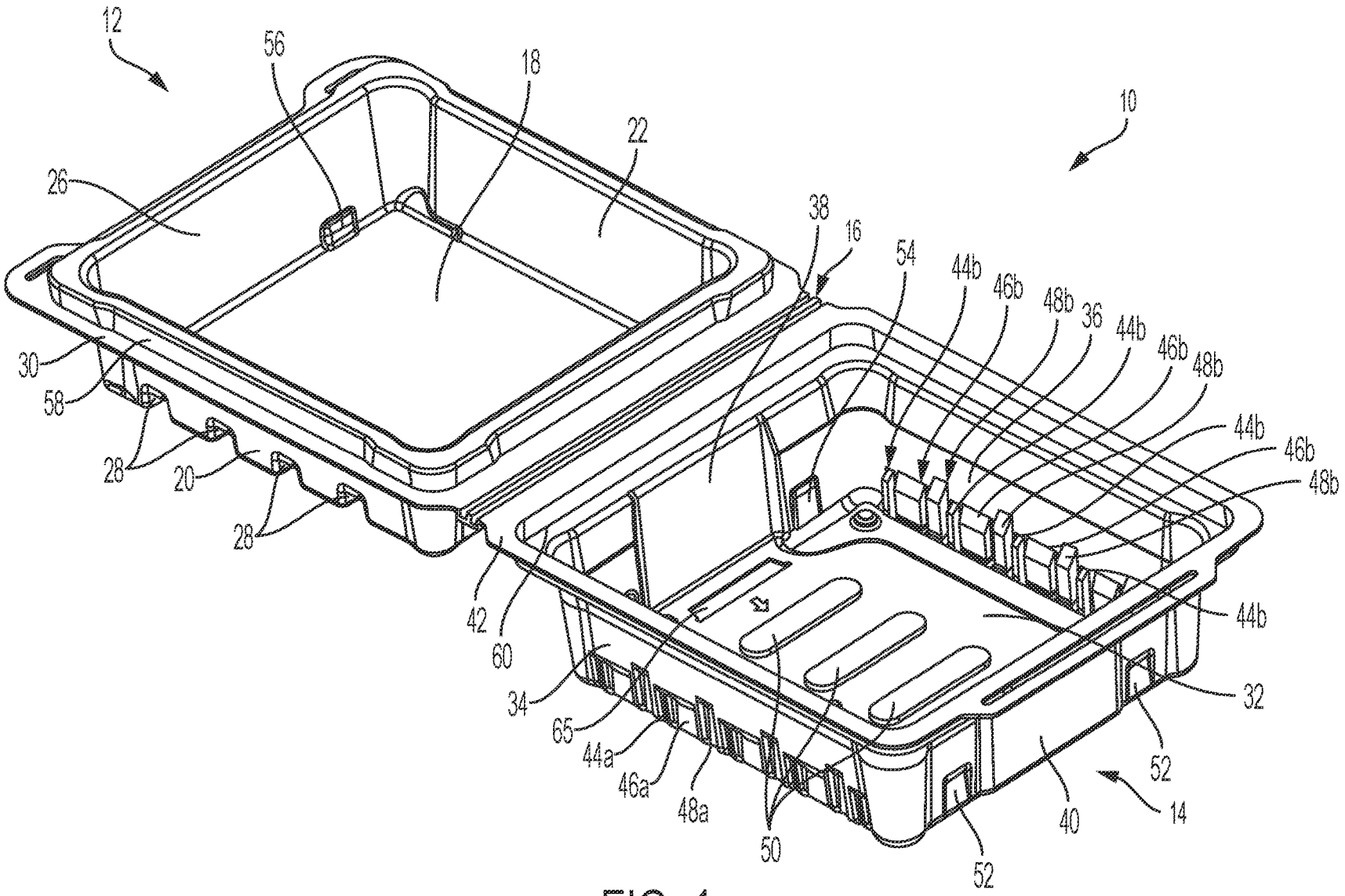
FIG. 1 is a perspective view of an embodiment of an assay plate package of the disclosure in an open position.

For purposes of convenience, the ensuing detailed description is made with reference to the figures, which are exemplary and not limiting or otherwise restrictive of the scope of the disclosure. As used throughout herein, the term "rectangular" includes the geometric shapes of rectangles and squares Referring to FIGS. 1, 2, 3, 4, 5 and 6, thereat is an embodiment of an assay plate package 10 comprised of upper shell 12 and lower shell 14 in a clamshell configuration connected to each other by hinge member 16. In the practice depicted, the upper and lower shells and hinge member are integrally formed and of unitary construction. Without limitation, the assay plate package can be formed by means known in the art, including, without limitation, molding, compression molding, injection molding, milling, and the like, using suitable materials such as without limitation, plastics, including poly-alphaolefins, e.g. polyethylene, polypropylene and the like, polycarbonate, nylons, polyesters, acrylics and the like. In one practice, the package can be integrally formed by being thermoformed from a single sheet comprised of a polymer such as a thermoplastic, e.g. a polyester, including polyethylene terephthalate (PET), and can comprise recycled PET. In one aspect, the polymer is transparent. Alternatively, the upper shell, lower shell and hinge can each can be separately made and attached together as individual component parts. Upper shell 12 comprises a substantially rectangular planar top panel 18 which has a pair of opposed substantially planar parallel first and second upper shell end walls, 24 and 26 respectively, and a pair of opposed substantially planar parallel first and second upper shell sidewalls, 20 and 22 respectively, all of which end walls 24, 26 and sidewalls 20, 22 extend substantially orthogonally from top panel 18. The upper shell 12 has at least one buttress element 28 located catercorner to a portion of the first upper shell sidewall 20 and top panel 18. A plurality of such buttress elements may be employed. The non-limiting practice depicted at FIGS. 1-6 illustrates four buttress elements 28.

Figure 14:
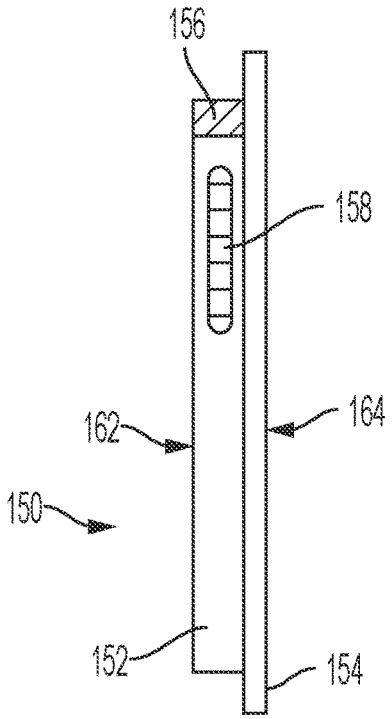
FIG. 14 is a side view of an embodiment of an assay plate contemplated by the disclosure.
Figure 15:
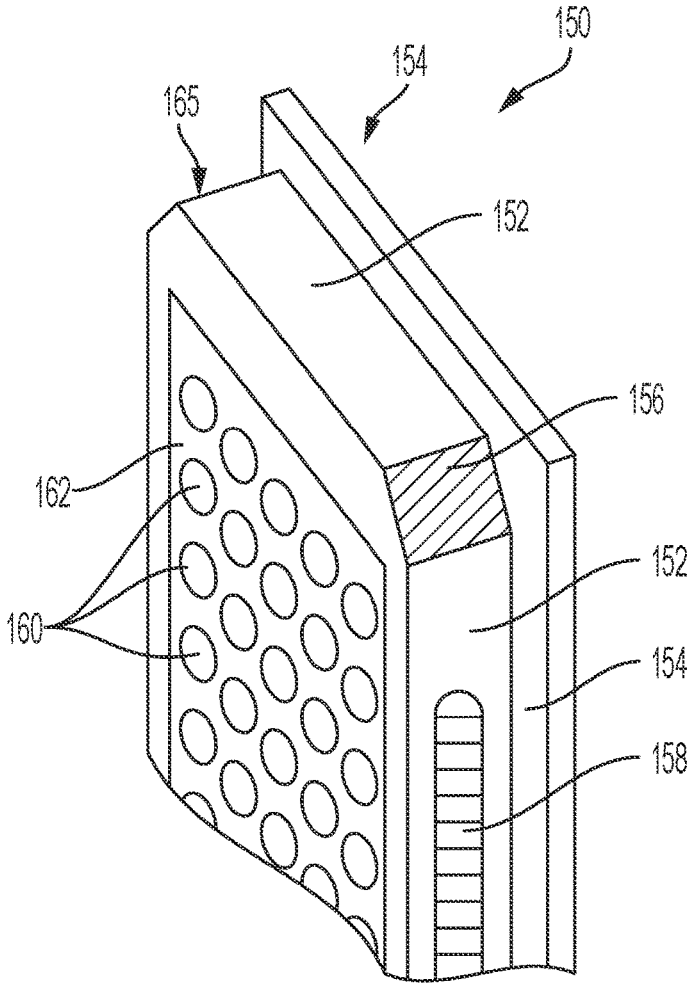
FIG. 15 is a partial perspective view of the embodiment of FIG. 14.
Figure 16:
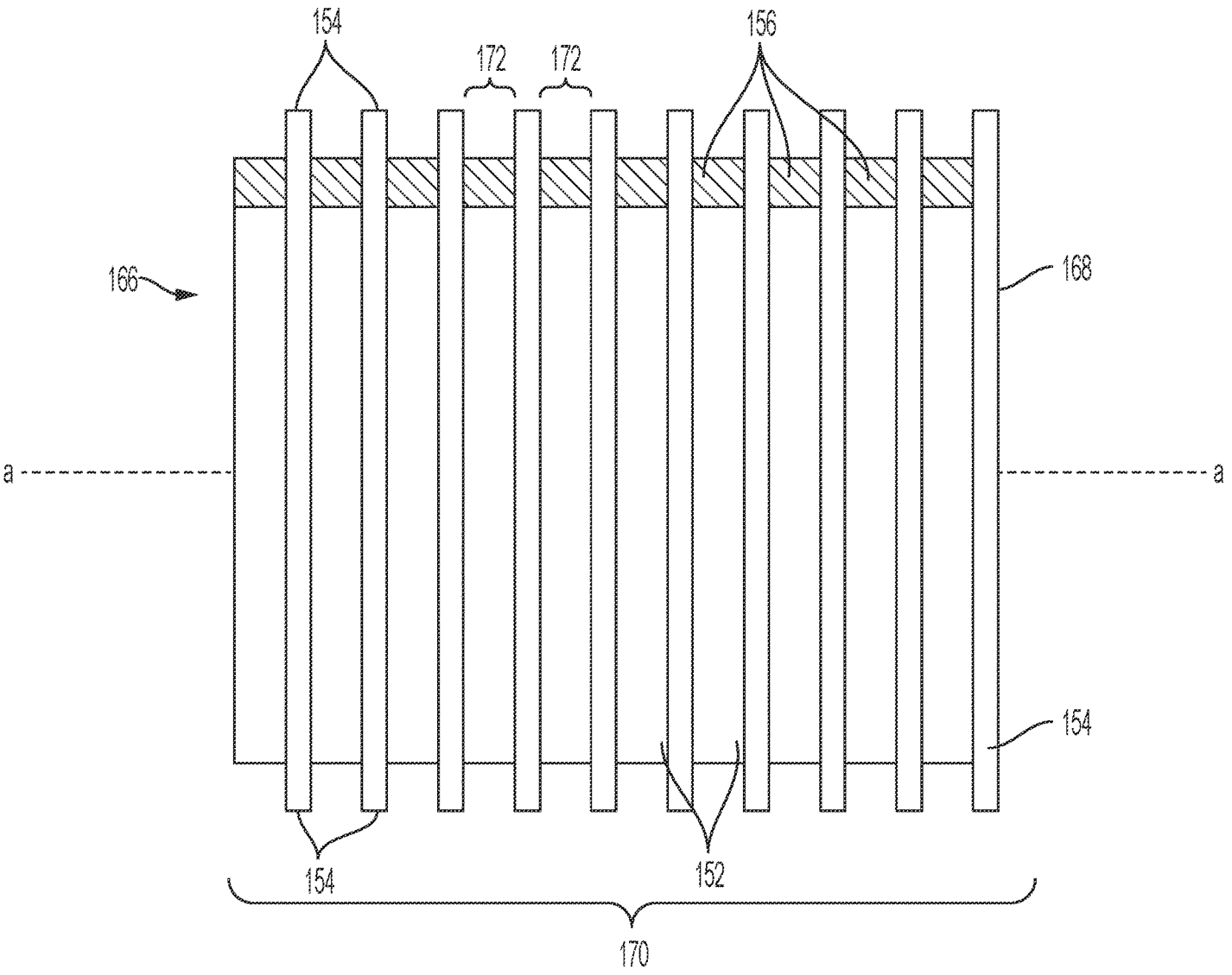
FIG. 16 is a side view of an embodiment of a stack of assay plates contemplated by the disclosure.
Figure 17:
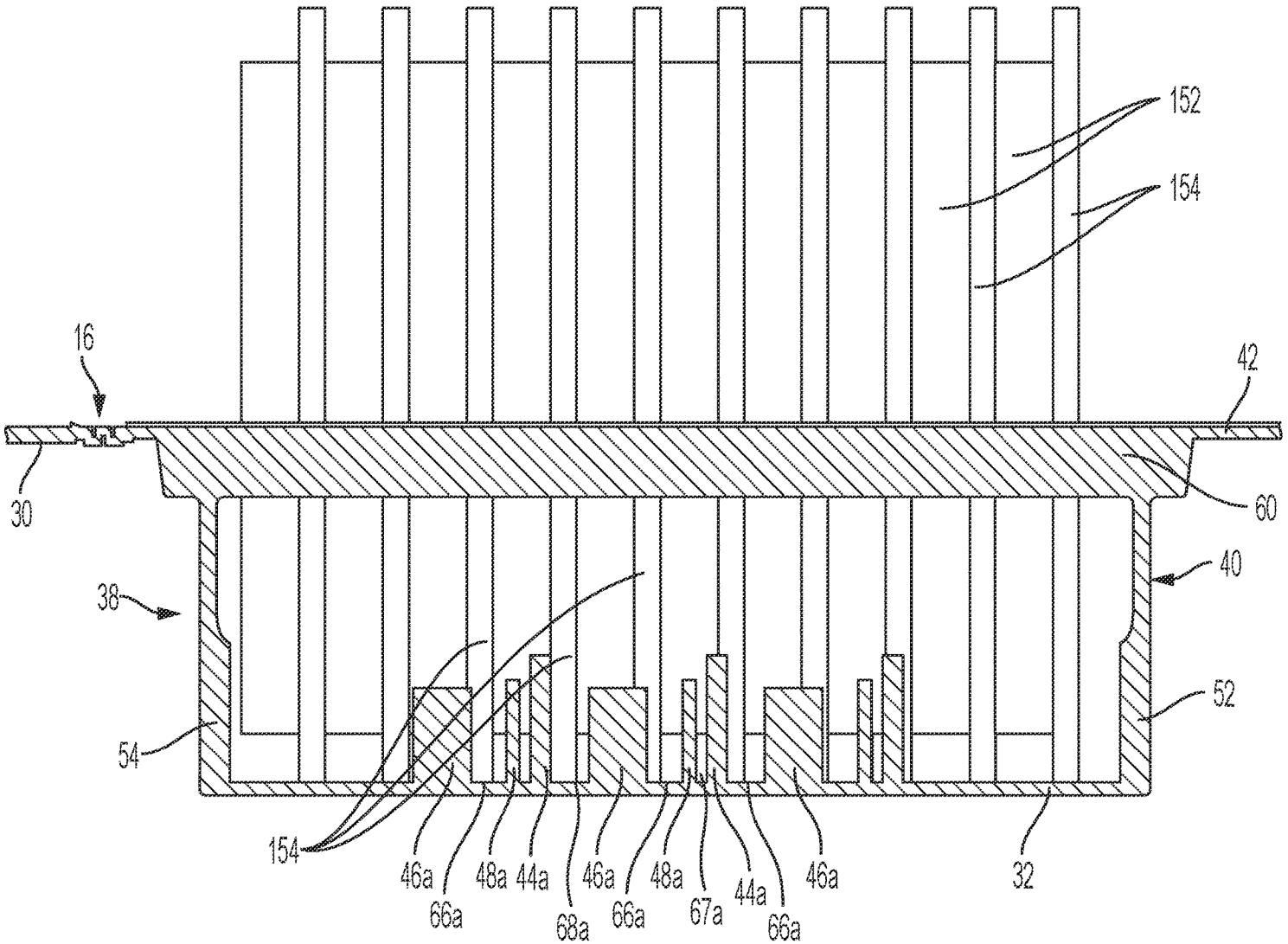
FIG. 17 is a side view of a stack of exemplary assay plates loaded into an embodiment of a lower shell of an assay plate package of the disclosure.
Figure 18:
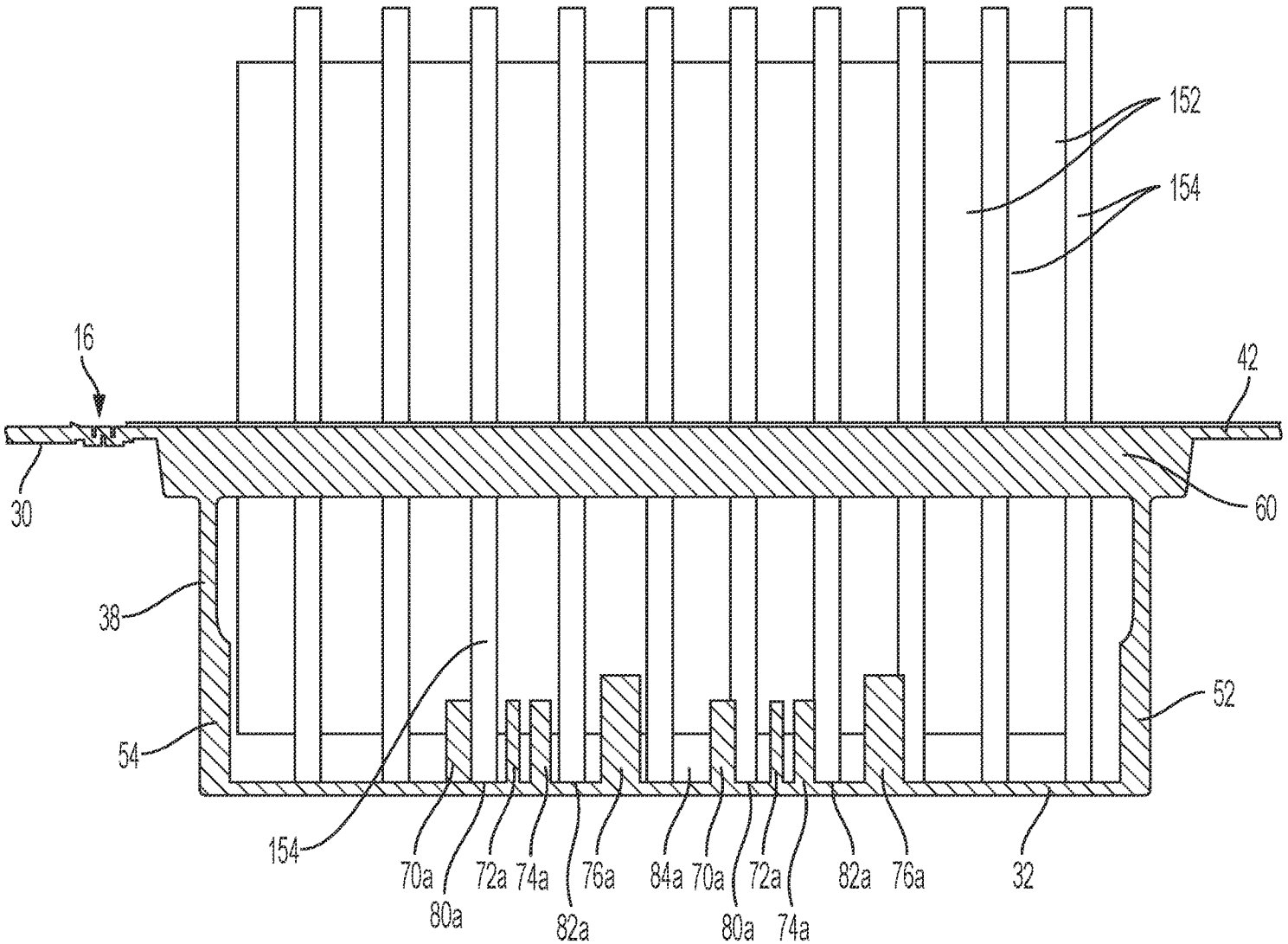
FIG. 18 is a side view of a stack of exemplary assay plates loaded into another embodiment of a lower shell of an assay plate package of the disclosure.

Referring now to FIGS. 14, 15 and 16, thereat is depicted a representative assay plate 150 for which the present disclosure provides a package. Plates can be coated or uncoated. Plate 150 as depicted is of substantially rectangular shape and comprises a top side 162 comprising a multiplicity of wells 160, a back side 164, and an edge flange 154 that extends around the entire periphery of the plate. Plate 150 further comprises an outer sidewall 152 that has a width which can vary depending upon the particular assay plate and which extends orthogonally from at or near the edge flange 154 and which also extends around the entire periphery of the plate. The plate 150 further has at least one chamfered corner portion 156 on the outer side wall 152 which cuts the corner portion at a diagonal. As shown, plate 150 has two chamfered corner portions 156 and 165 located on adjacent corners. Assay plate 150 optionally has a label or other attached or printed material thereon 158, containing machine or human readable information, e.g. product information pertaining to the particular plate or plates, such as without limitation, lot numbers, kit codes and the like; such information can also be directly printed onto the plate by, for example, laser printing and the like. In one practice, the assay package of the disclosure is sufficiently transparent to permit electronic scanning or visual reading of the label information. In another practice, the package comprises a transparent window or multiple such windows to access the information, the package being otherwise not transparent. The wall thickness of the assay plate package can vary within ranges as known in the art and can representatively include thicknesses for the upper shell and lower shell sufficient to render the assay package rigid or semi-rigid, for example and without limitation, wall thicknesses of about 0.025 inches to about 0.040 inches, such as e.g. about 0.035 inches. Further to FIG. 16, in one embodiment the plates are configured so as to be able to form a stack 170. FIG. 16 shows ten exemplary assay plates nested together to form a stack 170 where the chamfered corner portions 156 are in alignment in a common plane. As depicted, the stack 170 has an axial length along dotted line "a" from a first end of the stack corresponding to the assay plate at 166 to a second end of the stack corresponding to the assay plate at 168. As relates to stack 170, the flanges 154 of the individual plates are substantially equally spaced along the axial length of the stack and extend outwardly around the periphery of the stack. The flanges 154 thus form slots 172 therebetween, where in one practice illustrated, each slot has a chamfered portion 156.

Figure 13:
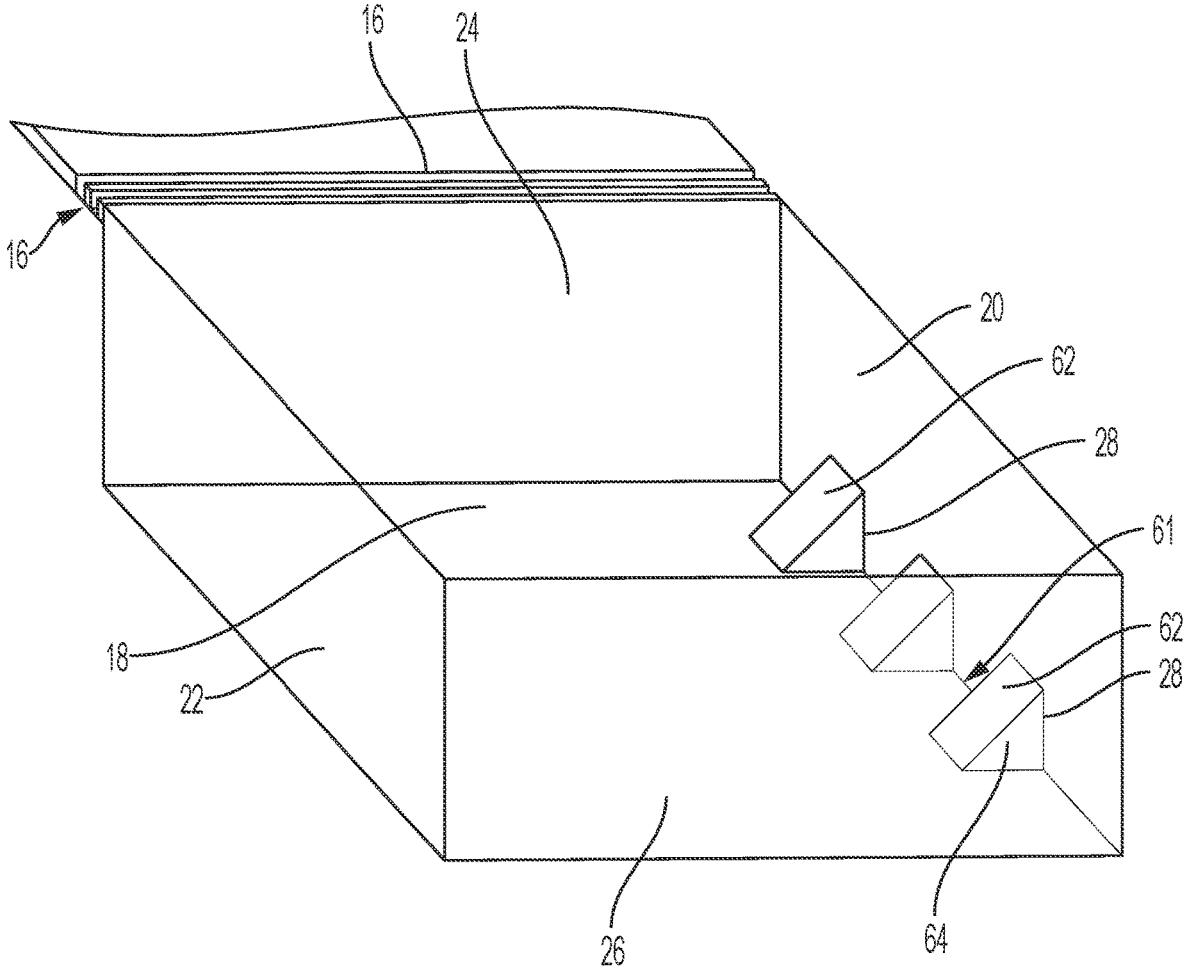
FIG. 13 is a depiction of a perspective view of the upper shell of an assay plate package of the disclosure in an open position.

Reverting back to FIGS. 1-6, upper shell 12 and lower shell 14 cooperatively define an internal cavity when the upper and lower shells are in a closed position. The cavity is configured to contain a plurality of substantially rectangular assay plates, such as representatively described and depicted in FIGS. 14 and 15, including a stack of such assay plates as illustrated in FIG. 16. Additional reference to FIG. 13 is had, which is a depiction of the buttress elements 28, three being shown. As indicated, each buttress element 28 has a sloped surface 62 that is complementary to the slope of a chamfered corner portion 156 of the plate. In the practice shown, sloped surface 62 extends diagonally from first upper shell sidewall 20 to top panel 18. Buttress elements 28 extend into the cavity when the upper and lower shells are in the closed position and are configured, e.g. by the length of extension and the slope of the buttress surface, to contact the chamfered portion of a respective plate. When the plates are formed into a stack 170, the buttress elements are configured to fit with the slots 172 to contact the chamfered corner portions 156. Buttress elements 28 are catercorner to top panel 18 and the first upper shell sidewall 20. In the practice shown, the buttress elements are substantially triangular in cross section, as seen by buttress side wall 64, and the buttress elements 28 are each located so as to at least partly straddle the edge 61 formed where top panel 18 meets first upper shell sidewall 20. In addition to the first upper shell sidewall 20, buttress elements 28 can be also located on second upper shell sidewall 22 either in either direct opposite alignment with those on the first upper shell sidewall 22 or in an alternating or other pattern from same. Buttress elements 28 can be formed integrally from first upper shell sidewall 20 and top panel 18 by way of molding, indents, and the like, or can be comprised of separate pieces attached catercorner to sidewall 22 and top panel 18.

Lower shell 14 comprises a substantially rectangular planar bottom panel 32 which has a pair of opposed substantially planar parallel first and second lower shell end walls, 38 and 40 respectively, and a pair of opposed substantially planar parallel first and second lower shell sidewalls 34 and 36 respectively, all of which end walls 38, 40, and sidewalls 34, 36, extend substantially orthogonally from bottom panel 32. At least one of the first or second lower shell sidewalls 34, 36 comprises at least one pair of laterally adjacent protrusions that extend outwardly into the cavity from the pertaining sidewall and which extend upwardly from the bottom panel 32. A given pair of adjacent protrusions form a groove therebetween configured to receive a first flange portion of the respective assay plate that is placed therein. In one practice, while all pairs of adjacent protrusions can form flange receiving grooves, not all such pairs of adjacent protrusions need do so; in one embodiment there are sufficient adjacent pairs of protrusions to form individual grooves for most of the flanges protruding from a stack of assay plates, e.g. the assay plates located at the each end of the stack may not have their flanges accommodated by a groove.

Without limitation, FIGS. 1-6 and 17 illustrate an embodiment wherein a laterally adjacent pair of protrusions 46*a* and 48*a* on the first lower shell sidewall 34 form groove 66*a* therebetween, and a pair of laterally adjacent protrusions 44*a* and 46*a* form groove 68*a* therebetween. The protrusions may but need not form a repeating pattern. The grooves 66*a* and 68*a* and so on are configured to receive a portion of a flange 154 associated with the respective assay plate placed therein. In the embodiment depicted, there is no flange within groove 67*a* that is formed between protrusion pairs 48*a* and 44*a*. The pattern of protrusions 44*a*, 46*a*, and 48*a* and their pertaining grooves may repeat along the length of first lower shell sidewall 34. Adjacent pairs of protrusions forming grooves for assay plate flanges may be located only on one of the lower shell side walls or on both. In the practices depicted herein, repeating protrusions 44*a*, 46*a*, and 48*a* forming grooves 66*a*, 67*a*, 68*a* are on the first lower shell sidewall 34 whereas protrusions 44*b*, 46*b*, and 48*b* forming grooves 66*b*, 67*b*, 68*b* are on the second lower shell sidewall 36. In one practice, the pairs of adjacent protrusions on the first lower shell sidewall are each directly opposite those on the second lower shell sidewall, e.g. protrusions 44*a*, 46*a*, 48*a* are respectively directly opposite and substantially identical in size and shape to protrusions 44*b*, 46*b*, 48*b* on the second lower shell sidewall; concomitantly, the grooves 66*a*, 67*a*, 68*a* and so on formed on the first lower shell sidewall 34 are aligned with grooves 66*b*, 67*b*, 68*b* and so on formed on the second lower shell sidewall 36 so that grooves opposite each other designed to hold an assay plate flange will respectively receive first and second flange portions of the same respective assay plate placed therein. In one aspect, one or more protrusions, e.g. 44*a*, 46*a*, 48*a*, 44*b*, 46*b*, and/or 48*b* can have an upper portion that is distal from the bottom panel 32 and which portion is configured to be in direct contact with a portion of the assay plate outer sidewall 152, see e.g. FIG. 17 wherein protrusions 46*a*, 44*a*, 48*a* all extend upwardly from bottom panel 32 a distance sufficient to have their distal portions overlap and contact the various outer plate sidewalls 152. In one embodiment, the upper ends of the distal portions are beveled to facilitate loading of the assay plates by providing a surface over which the assay plates outer sidewalls can slide.

Figure 2:
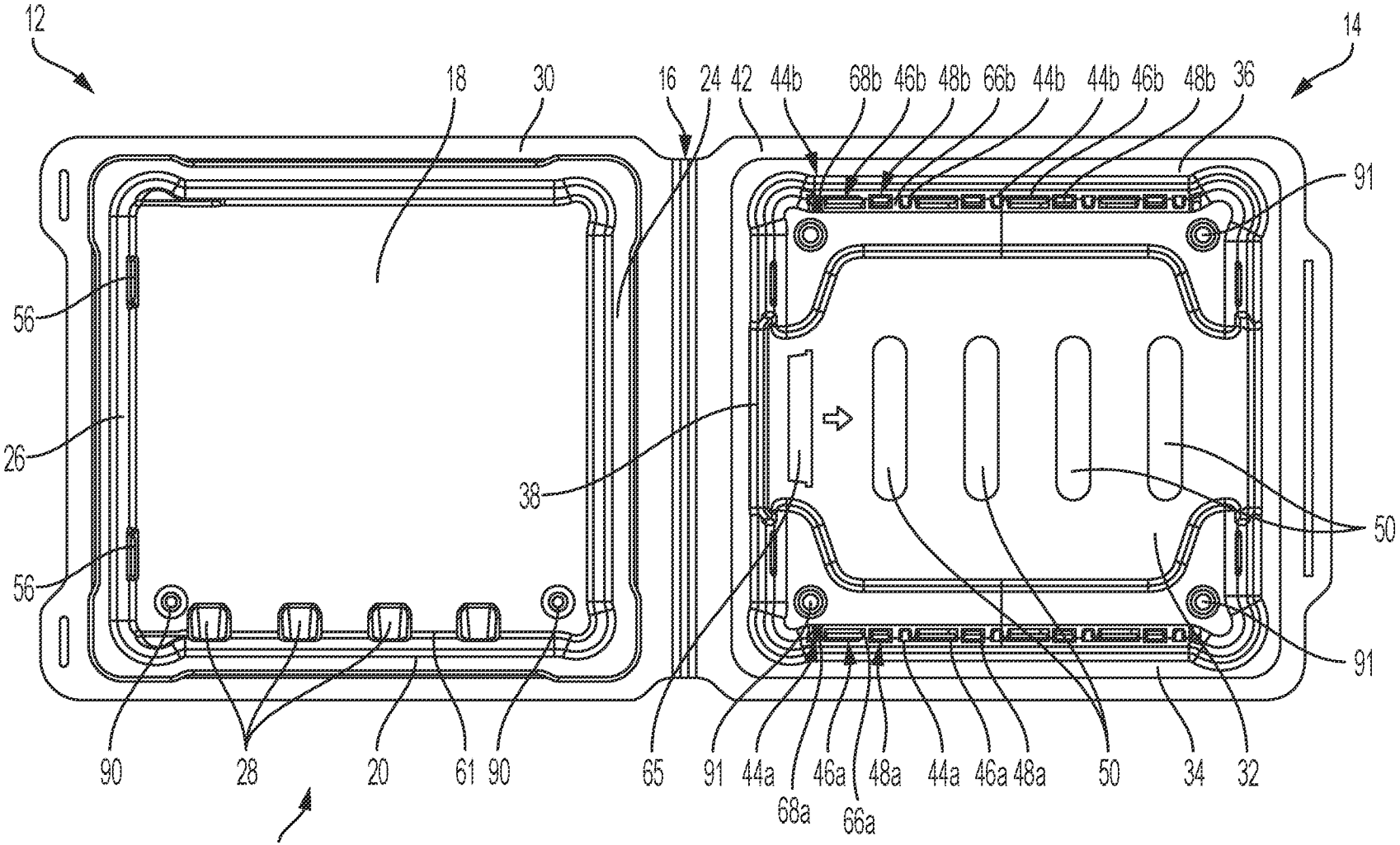
FIG. 2 is a top view of the embodiment of FIG. 1.
Figure 3:
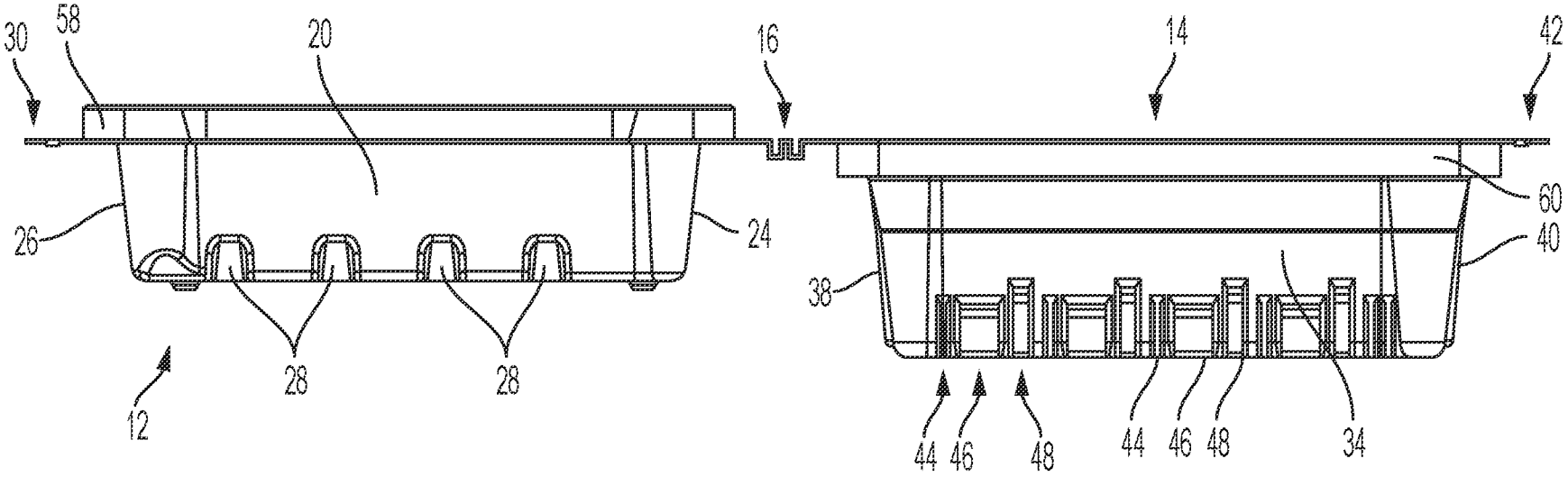
FIG. 3 is a side view of the embodiment of FIG. 1.
Figure 4:
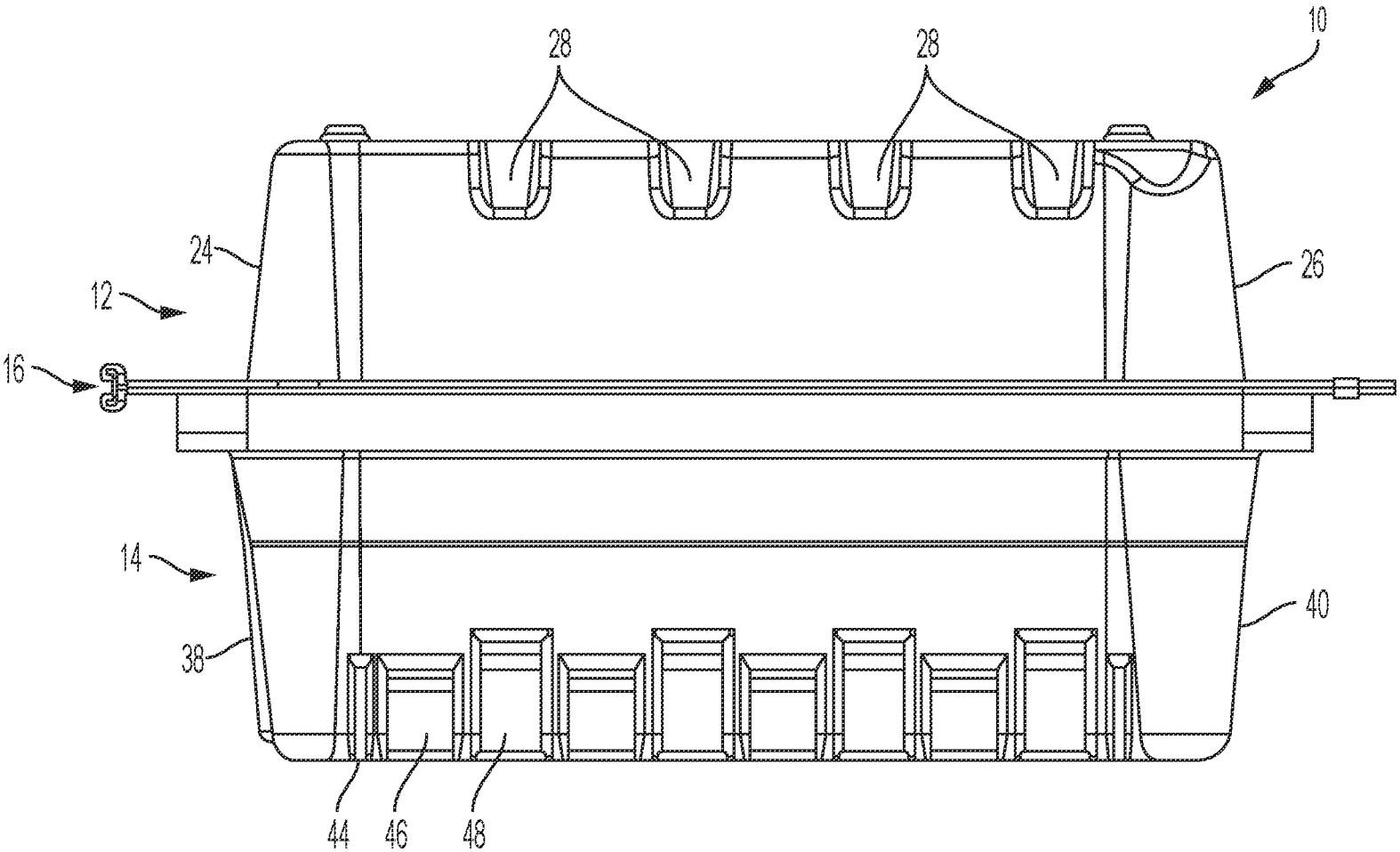
FIG. 4 is a side view of the embodiment of FIG. 1 in a closed position.
Figure 5:
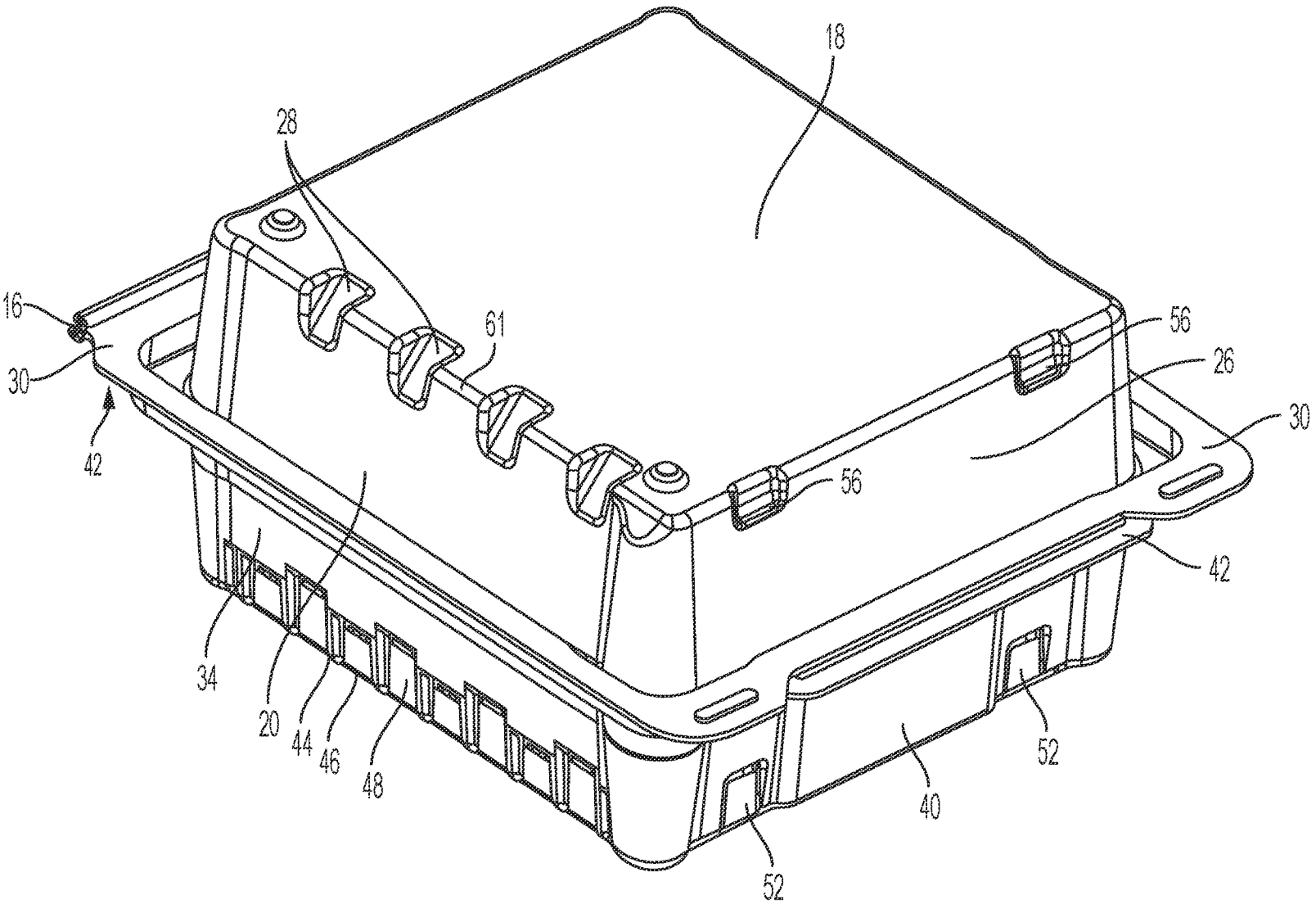
FIG. 5 is a perspective view of the embodiment of FIG. 4.
Figure 6:
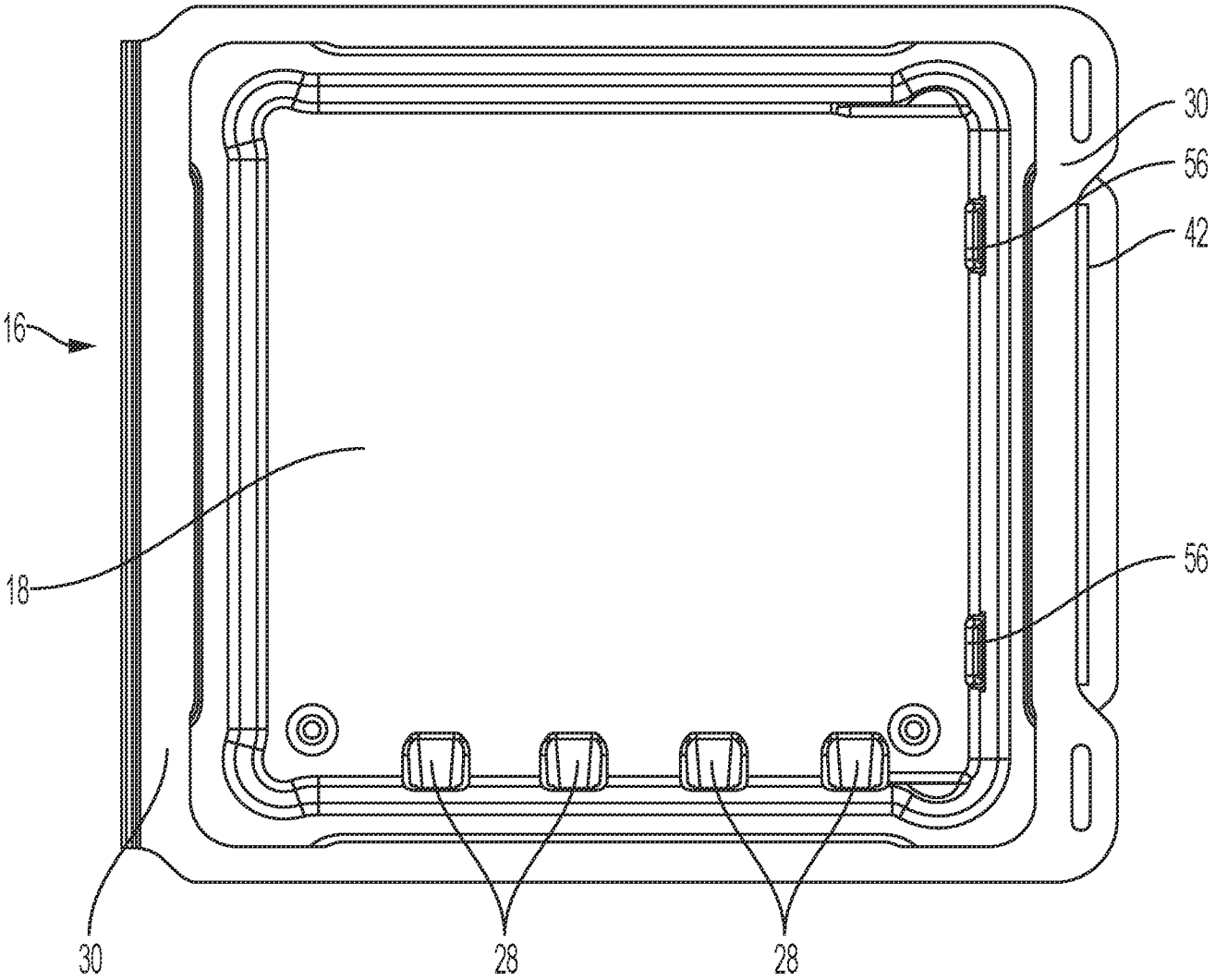
FIG. 6 is a top view of the embodiment of FIG. 4.
Figure 7:
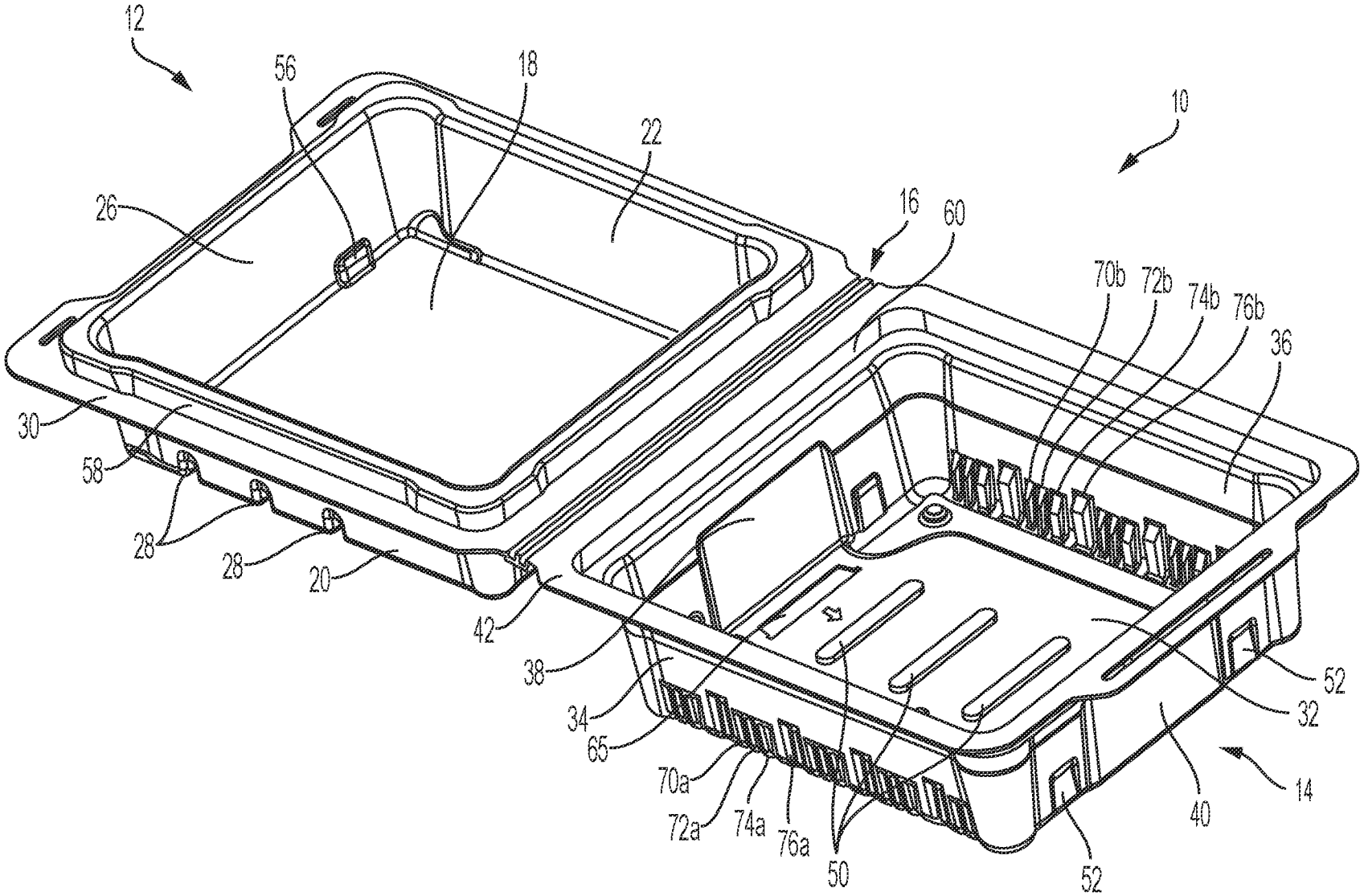
FIG. 7 is a perspective view of another embodiment of an assay plate package of the disclosure in an open position.
Figure 8:
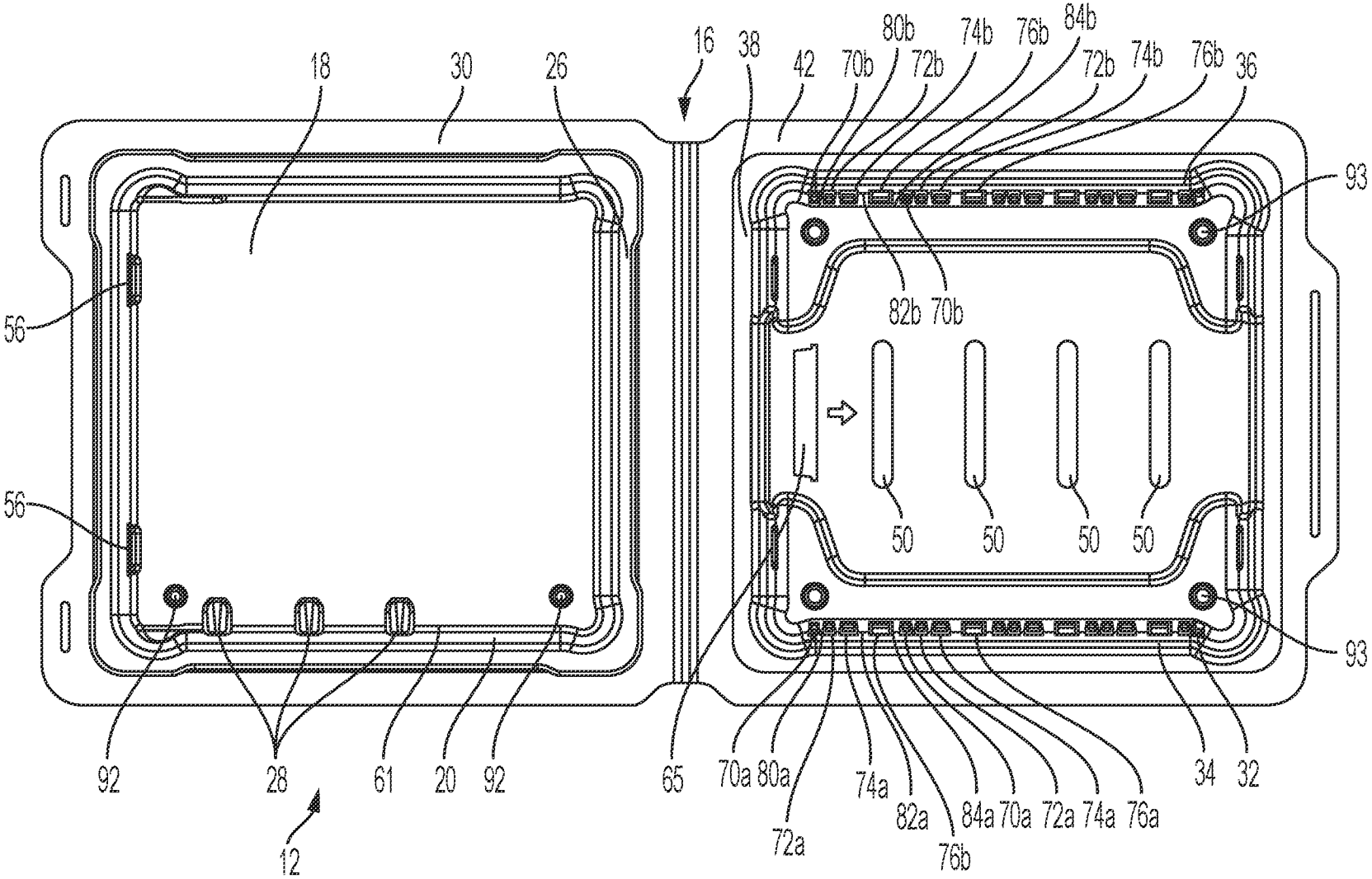
FIG. 8 is a top view of the embodiment of FIG. 7.
Figure 9:
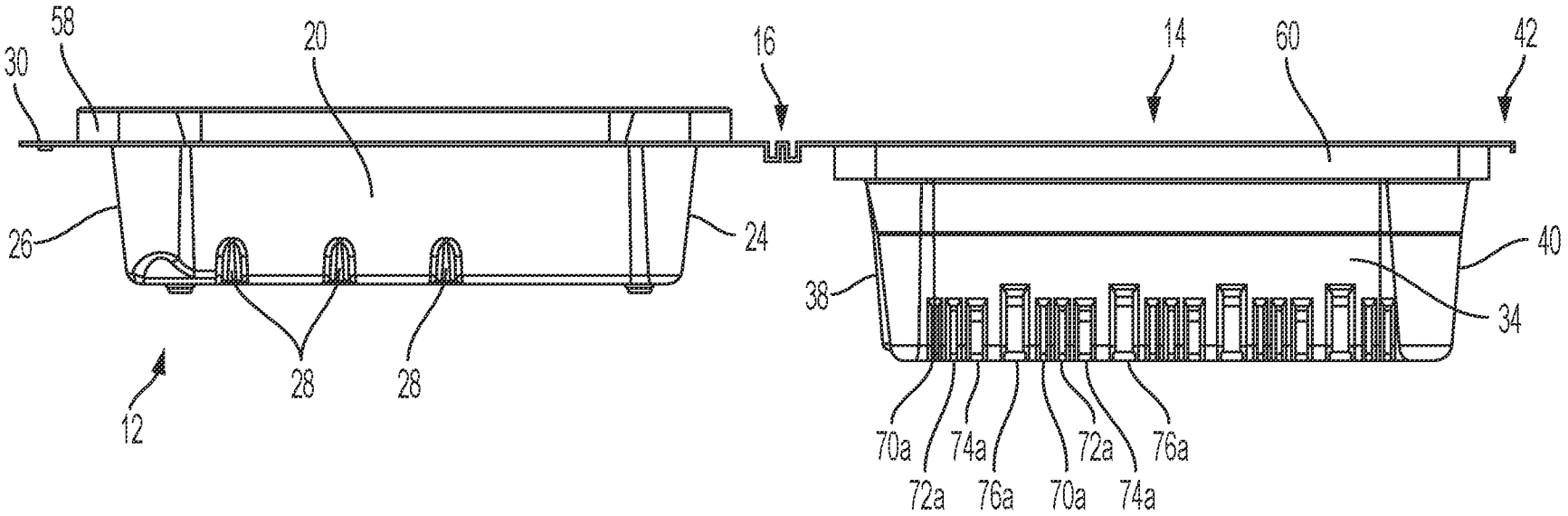
FIG. 9 is a side view of the embodiment of FIG. 7.
Figure 10:
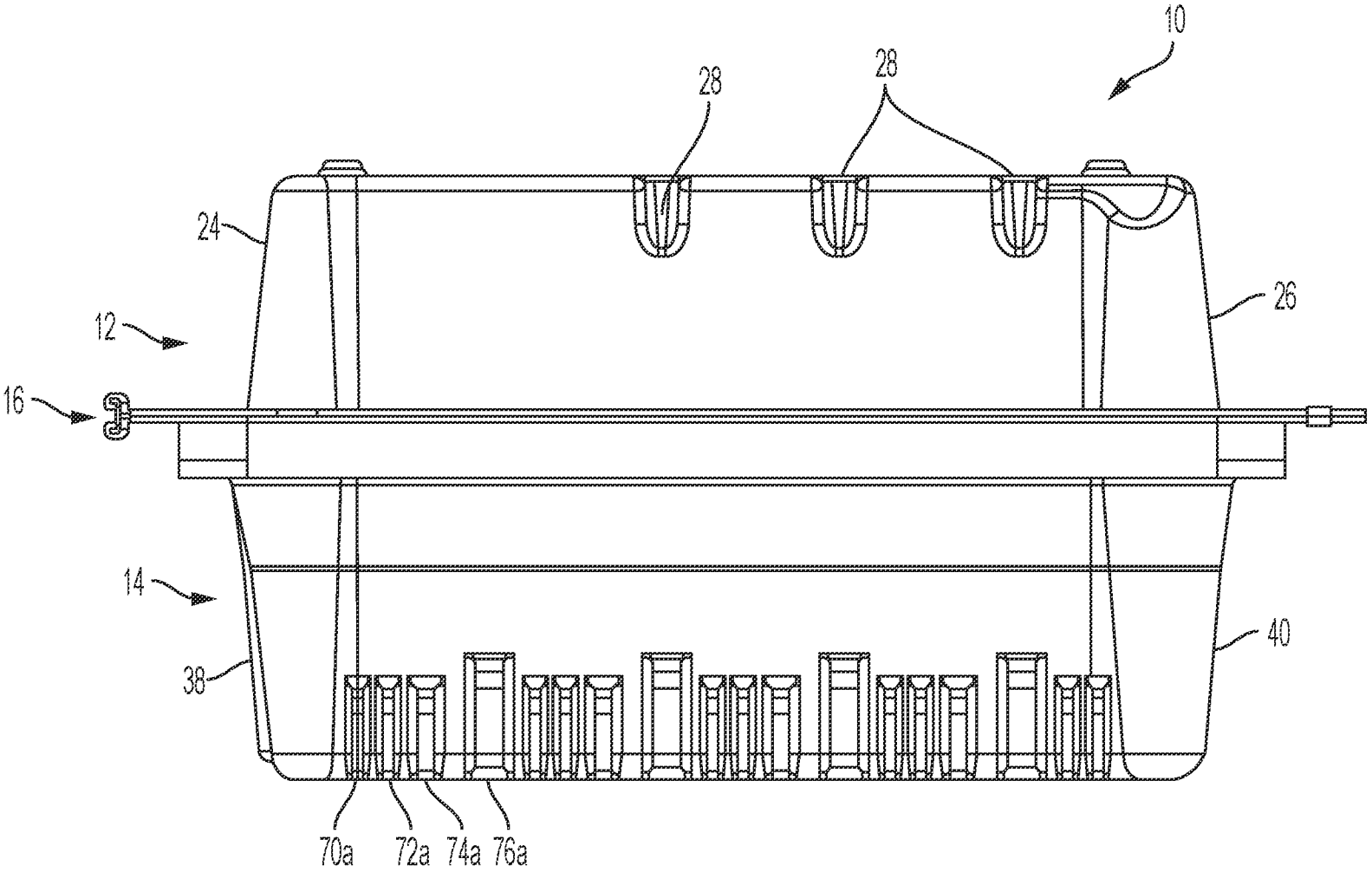
FIG. 10 is a side view of the embodiment of FIG. 7 in a closed position.
Figure 11:
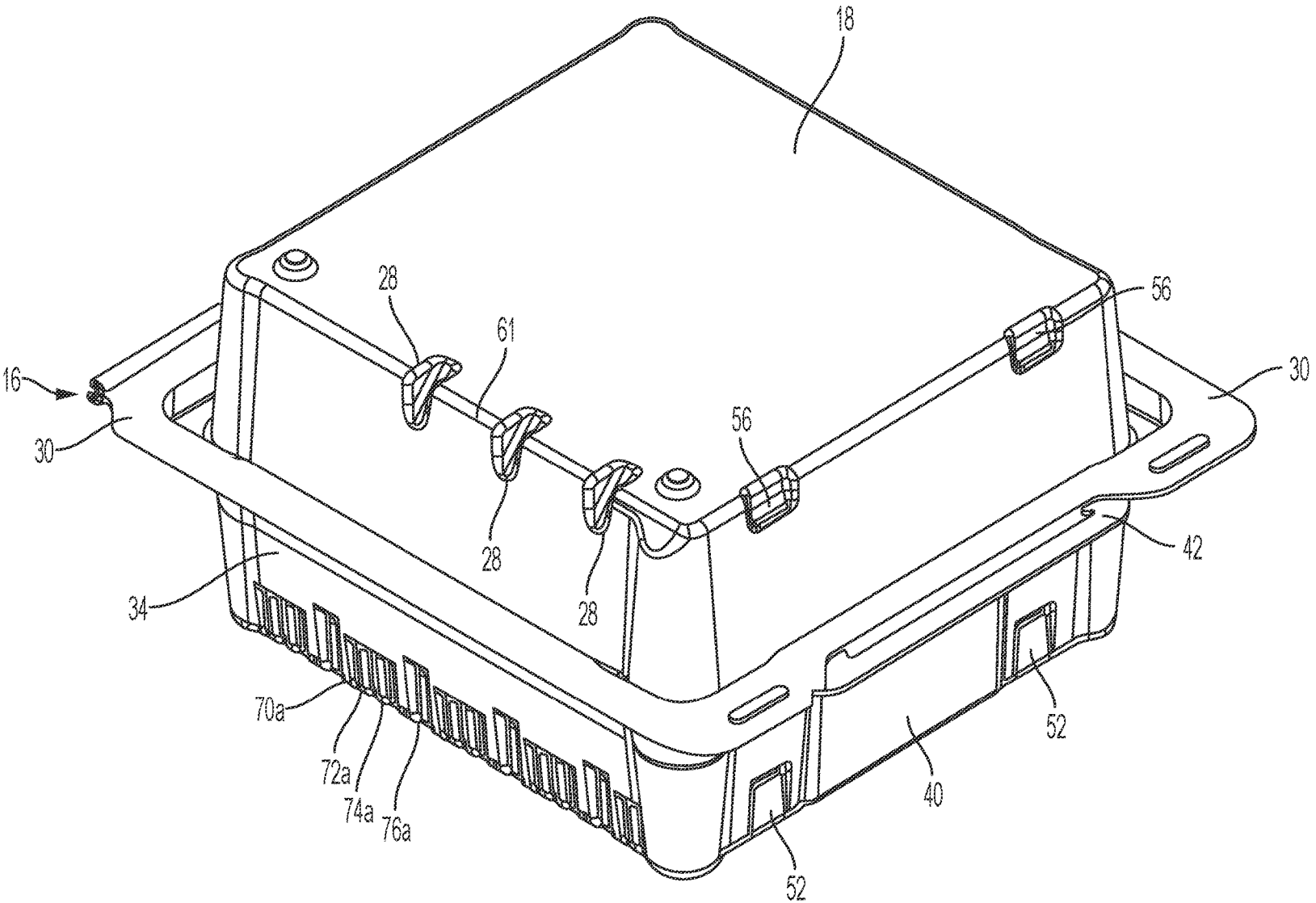
FIG. 11 is a perspective view of the embodiment of FIG. 10.
Figure 12:
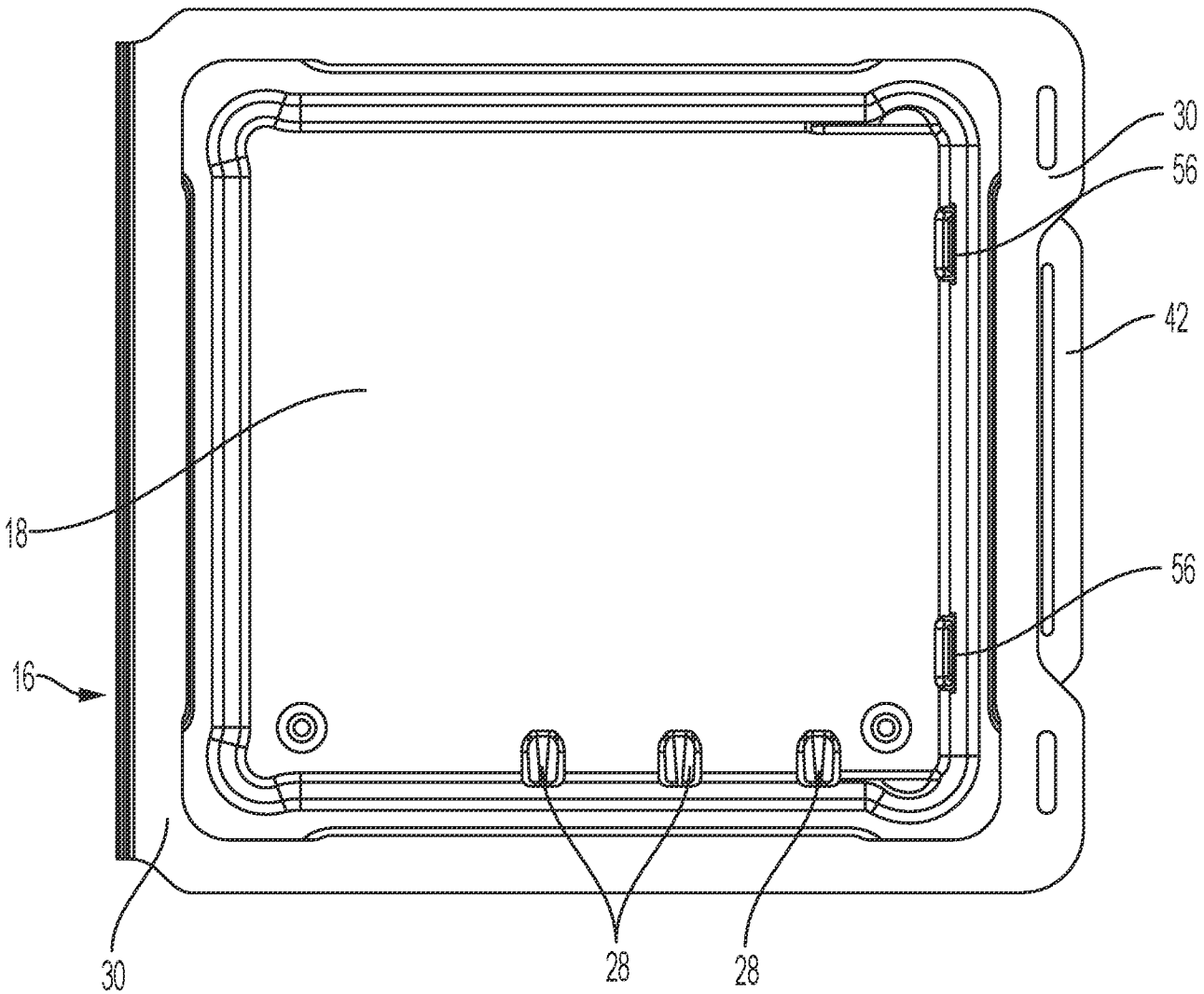
FIG. 12 is a top view of the embodiment of FIG. 10.

As further shown in FIGS. 1 and 2, bottom panel 32 comprises at least one elongated projection 50, four being representatively shown, that extends into the cavity and is substantially parallel to the lower shell end walls 38 and 40. The elongated projections 50 are configured to contact a portion of the assay plate sidewall 152 that is proximate the bottom panel when placed in the assay package of the disclosure. In one practice, each elongated projection 50 is of a size and shape to fit within slots 172 formed between flanges 156 in stack 170 as depicted in FIG. 16, e.g. one or more elongated projections 50 can have a width substantially the same as the width of a particular assay plate outer sidewall, which outer sidewall width corresponds to the width of a slot 172. In the practice shown, hinge member 16 connects the first upper shell end wall 24 with the first lower shell end wall 38 to permit the upper shell 12 and the lower shell 14 to be selectively moved between an open position and a closed position. Without limitation, in one practice, upper shell 12 comprises an encircling peripheral flange 30 which extends outwardly and orthogonally from the upper shell end walls 24, 26 and upper shell sidewalls 20 and 22; lower shell 14 comprises an encircling peripheral flange 42 which extends outwardly and orthogonally from lower shell end walls 38, 40; hinge member 16 connects upper and lower shells 12 and 14 by way of flanges 30 and 42, e.g. hinge member 16 can be integrally formed with flanges 30 and 42.

In one embodiment, upper shell 12 can further comprise a male rim portion 58 which extends above and around the periphery of the upper shell 12 and is substantially parallel to the upper shell end walls 24, 26 and sidewalls 18, 20 and which is configured to fit into and mate with female well portion 60 which extends around and below the periphery of the lower shell 14 and is substantially parallel with the lower shell end walls 38, 40 and sidewalls 34, 36; this embodiment will increase physical stability to the assay package and offer additional protection from the elements to assay plates that have sensitive surfaces, e.g. the carbon surfaces of certain products also act as adsorbents and are hence sensitive to air; this embodiment helps prevent air from flowing in and out of the assay package, which air flow would otherwise alter the carbon surfaces. Continuing, upper shell end walls 24, 26 can optionally each individually further comprise at least one abutment 56 which extends from the end wall and into the cavity and is configured to seat against a portion of the top side or a portion of the bottom side of the terminal assay plates at 166 and/or 168 in stack 170 as exemplified in FIG. 16. Similarly, lower shell end walls 38, 40 can optionally each individually further comprise at least one abutment 52 which extends from the end wall and into the cavity and is configured to seat against another portion of the top surface or portion of the bottom surface of the terminal assay plates at 166 and/or 168 in stack 170. Bottom panel 32 can further optionally comprise a directional moiety 65 shown with an accompanying arrow which can be printed on or formed from the bottom panel and which indicates the direction in which the assay plates are to be loaded into the package, e.g. how the flanges should be oriented. Optionally, one or more complementary protuberances 90 and recesses 91 for facilitating stacking of assay plate packages can be present on the upper and/or lower shells.

FIGS. 7-12 and 18 depict another embodiment of the assay plate package of the disclosure. This embodiment shares various features commonly enumerated above in the practice shown in FIGS. 1-6 and 17. The embodiment shown in FIGS. 7-12 comprises three buttresses elements 28 which are of a different width than those of FIGS. 1-6 so as to accommodate thinner assay plates. FIGS. 7-12 and 18 further depict another pattern for the laterally adjacent protrusions some or all of which form grooves for receiving pertaining portions of the assay plate flanges placed within.

As depicted, in these figures the first lower shell sidewall 34 has a pair of laterally adjacent protrusions 70*a* and 72*a* which form groove 80*a* whereas the pair of adjacent protrusions 74*a* and 76*a* form groove 82*a* and the pair of adjacent protrusions 76*a* and 70*a* form groove 84*a*, which grooves 80*a*, 82*a*, and 84*a* are configured to receive portions of assay plate flanges respectively placed therein. In the practice shown, the groove formed between protrusion 72*a* and 74*a* does not receive a flange. The pattern in which protrusions 70*a*, 72*a*, 74*a*, 76*a* and grooves 80*a*, 82*a*, 84*a* appear may be repeated along all or part of the first lower shell sidewall 34 so as to accommodate a plurality of assay plates, such as the stack 170 representatively depicted in FIG. 16. In the embodiment illustrated, second lower shell sidewall 36 comprises a pattern of protrusions 70*b*, 72*b*, 74*b*, 76*b* which are directly opposite and are of substantially the same size and shape of counterpart protrusions 70*a*, 72*a*,

74*a*, 76*a* and grooves 80*b*, 82*b*, and 84*b* formed respectively formed from protrusion pairs 70*b* and 72*b*, 74*b* and 76*b*, and 76*b* and 70*b* are aligned with opposite counterpart grooves 80*a*, 82*a*, 84*a*, and 86*a* so as to each respectively receive first and second flange portions of the same respective assay plate placed therein. In one aspect, one or more the protrusions can have an upper portion distal from the bottom panel 32 that is configured to be in direct contact with and portion of the assay plate outer wall 152, see e.g. FIG. 18 wherein protrusions 70*a*, 72*a*, 74*a*, 76*a* all extend upwardly from bottom panel 32 a distance sufficient to have their distal portions overlap and contact the various outer plate sidewalls 152.

Flange receiving grooves 66*a* and 68*a* are on the first lower shell sidewall 34 whereas protrusions 44*b*, 46*b*, and 48*b* forming grooves 66*b* and 68*b* are on the second lower shell sidewall 36. In one practice, the pairs of adjacent protrusions on the first lower shell sidewall are each directly opposite, e.g. protrusions 44*a*, 46*a*, 48*a* are respectively directly opposite and substantially identical in size and shape to protrusions 44*b*, 46*b*, 48*b* on the second lower shell sidewall; concomitantly, the grooves 66*a*, 68*a* and so on formed on the first lower shell sidewall 34 are aligned with grooves 66*b*, 68*b* and so on formed on the second lower shell sidewall 36 so as to respectively receive first and second flange portions of the same respective assay plate placed therein. In one aspect, one or more protrusions, e.g. 46*a*, 44*a*, 48*a*, 46*b*, 44*b*, and/or 48*b* can have an upper portion distal from the bottom panel 32 that is configured to be in direct contact with and portion of the assay plate outer wall 152, see e.g. FIG. 17 wherein protrusions 46*a*, 44*a*, 48*a* all extend upwardly from bottom panel 32 a distance sufficient to have their distal portions overlap and contact the various outer plate sidewalls 152. In one embodiment, the upper ends of the distal portions are beveled to facilitate loading of the assay plates by providing a surface over which the assay plates outer sidewalls can slide. Optionally, one or more complementary protuberances 92 and recesses 93 for facilitating stacking of assay plate packages can be present on the upper and/or lower shells In one practice, the internal cavity of the assay plate package of the disclosure that is defined when upper shell 12 and lower shell 14 are in a closed position is slightly greater than the dimensions of a stack of assay plates as representatively shown at 170. Similarly, buttress elements 28 and/or elongated projections 50 can be configured to snugly fit within slots 152, and likewise the adjacent protrusions can be configured so that portions of same firmly contact the outer sidewalls of the assay plates and configured so that the grooves formed therebetween securely hold respective flange portions, thereby rendering the stack of assay plates substantially immovable when contained in the assay plate package in a closed position, and even including in an open position, where the assay plates will remain in their locations and not fall over when the package is opened and stays opened; moreover, each individual assay plate stays fully supported in the package even when one or more plates have been removed, including when all plates but one have been removed.

What is claimed is:

1. An assay plate package comprising:

an upper shell connected by a hinge member to a lower shell and cooperatively defining with the lower shell a cavity when the upper and lower shells are in a closed position, the cavity configured to contain a plurality of substantially rectangular assay plates, each plate comprising a front side and a back side, an edge flange extending around the periphery of the plate, a plate outer sidewall having a width and extending orthogonally from the edge flange and around the periphery of the plate, and a chamfered corner portion, the upper shell comprising a substantially rectangular planar top panel having a pair of opposed substantially parallel first and second upper shell end walls, a pair of opposed substantially parallel first and second upper shell sidewalls, and at least one buttress element located catercorner to a portion of the first upper shell sidewall and the top panel and extending into the cavity, the buttress element having a sloped surface complementary to the chamfered corner portion of the assay plate and configured to contact the chamfered corner portion of a respective assay plate when the upper and lower shells are in a closed position, and the lower shell comprising a substantially rectangular planar bottom panel having a pair of opposed substantially parallel first and second lower shell end walls, a pair of opposed substantially parallel first and second lower shell sidewalls, at least one of the first lower shell sidewall or the second lower shell sidewall comprises at least one pair of adjacent protrusions extending into the cavity from the first lower shell sidewall or second lower shell sidewall upwardly from the bottom panel, the pair of adjacent protrusions forming a first groove therebetween, the first groove configured to receive a first portion of a flange of a respective assay plate.

2. The assay plate package of claim 1 wherein the other of the first or second lower shell sidewall comprises at least one second pair of adjacent protrusions extending into the cavity from the other of the first lower shell sidewall or the second lower shell sidewall upwardly from the bottom panel, the second pair of adjacent protrusions forming a second groove therebetween, the second groove configured to receive a second portion of the flange of the respective assay plate, the second groove directly opposite and aligned with the first groove.

3. The assay plate package of claim 2 wherein the pair of adjacent protrusions on the first lower shell sidewall have the same or different width; and the pair of second adjacent protrusions on the second lower shell sidewall have the same or different width.

4. The assay plate package of claim 1 wherein at least one of the pair of adjacent protrusions has an upper portion distal from the bottom panel, the distal portion configured to be in contact with a portion of an outer sidewall of the respective assay plate.

5. The assay plate package of claim 4 wherein the upper portion distal from the bottom panel is beveled.

6. The assay plate package of claim 5 wherein the bottom panel has at least one elongated projection extending into the cavity and substantially parallel to the first and second lower shell end walls, the elongated projection configured to contact a portion of an outer sidewall of an assay plate.

7. The assay plate package of claim 6 wherein the at least one elongated projection has a width substantially the same as the width of the outer sidewall of the assay plate and is located at a central portion of the bottom panel.

8. The assay plate package of claim 1 wherein the hinge member connects the first upper shell end wall and the first lower shell end wall and permits the upper shell and lower shell to be selectively moved between an open position and a closed position.

9. The assay plate package of claim 1 wherein the upper shell and lower shell each comprise complementary mating portions to hold the upper and lower shells in a closed position.

10. The assay plate package of claim 1 wherein the upper shell, the lower shell, and the hinge member are integrally formed and comprise a transparent polymer.

11. The assay plate of claim 1 wherein the first lower shell end wall comprises at least one abutment extending from the first lower shell end wall and into the cavity and configured to contact the top side or bottom side of a respective assay plate when the upper and lower shells are in a closed position, and the second lower shell end wall comprises at least one abutment extending from the second lower shell end wall and into the cavity and configured to seat against the other of the top side or bottom side of another respective assay plate when the upper and lower shells are in a closed position.

12. An assay plate package comprising:

an upper shell connected by a hinge member to a lower shell and cooperatively defining with the lower shell a cavity when the upper and lower shells are in a closed position, the cavity configured to contain a stack of nested, substantially rectangular assay plates, the stack having a first end and a second end and comprising a plurality of equally spaced flanges disposed along the axial length of the stack from the first end to the second end, the flanges extending around the periphery of the stack, the flanges forming slots therebetween, each slot having a chamfered corner portion;

the upper shell comprising a substantially rectangular planar top panel having a pair of opposed substantially parallel first and second upper shell end walls, a pair of opposed substantially parallel first and second upper shell sidewalls, and a plurality of buttress elements located catercorner to and along at least part of the inside edge formed by the top panel and the first upper shell sidewall, each buttress element extending into the cavity and configured to snugly fit into a slot on the stack and having a sloped surface complementary to the chamfered corner portion of the slot to contact the chamfered corner portion when the upper and lower shells are in a closed position;

the lower shell comprising a substantially rectangular planar bottom panel having a pair of opposed substantially parallel first and second lower shell end walls, a pair of opposed substantially parallel first and second lower shell sidewalls;

the first lower shell sidewall comprising at least one first pair of first and second adjacent protrusions extending into the cavity from the first lower shell sidewall upwardly from the bottom panel, the first and second adjacent protrusions forming a first groove therebetween, the first groove configured to receive a first flange portion of a respective assay plate in the stack; and the second lower shell sidewall comprising at least one second engagement segment comprising a pair of third and fourth adjacent protrusions extending into the cavity from the second lower shell sidewall upwardly from the bottom panel, the adjacent protrusions forming a second groove therebetween, the second groove directly opposite and aligned with the first groove and configured to receive a second flange portion of the same respective assay plate.

13. The assay plate package of claim 12 wherein at least one of the first or second adjacent protrusions is configured to fit snugly within the slot formed between the flange of the respective assay plate and the flange of an adjacent assay plate in the stack.

14. The assay plate package of claim 13 wherein the first lower shell end wall comprises at least one abutment extending from the first lower shell end wall and into the cavity and configured to seat against the first end of the stack when the upper and lower shells are in a closed position, and the second lower shell end wall comprises at least one abutment extending from the second lower shell end wall and into the cavity and configured to seat against the second end of the stack when the upper and lower shells are in a closed position.

15. The assay plate package of claim 14 wherein the upper shell, lower shell, and hinge element each individually comprise the same or different plastic.

16. The assay plate package of claim 14 wherein the upper shell, lower shell, and hinge element are integrally formed of transparent polyethylene terephthalate.

17. An assay plate package comprising:

a cavity defined by a top panel comprising peripheral top sidewalls, and an opposed bottom panel comprising peripheral bottom sidewalls;

a plurality of sloped buttress elements extending into the cavity and spaced across at least a portion of an inside edge where the top panel meets a respective top panel sidewall;

one or more protrusions extending from respective bottom sidewalls into the cavity with adjacent protrusions forming a respective groove; and a stack of nested assay plates, each plate comprising a flange and an assay plate outer side wall, the assay plate outer sidewalls of adjacent flanges each forming a slot, wherein a respective flange fits into a respective groove, and the sloped surface of a respective buttress element fits into a respective slot, and wherein the flange of each assay plate is oriented perpendicular to the top panel and the bottom panel.

18. The assay plate package of claim 17, wherein the plates are equally spaced apart in the stack.

* * * * *